US006948700B2

(12) United States Patent
Wood

(10) Patent No.: US 6,948,700 B2
(45) Date of Patent: Sep. 27, 2005

(54) TELESCOPING DEMOLITION TOOL

(76) Inventor: Robert S Wood, 3199 Cove Ave, Innisfil, ON (CA), L9S 2K7

( * ) Notice: Subject to any disclaimer, the term of this patent is extended or adjusted under 35 U.S.C. 154(b) by 94 days.

(21) Appl. No.: 10/436,259

(22) Filed: May 13, 2003

(65) Prior Publication Data

US 2004/0227131 A1 Nov. 18, 2004

(51) Int. Cl.[7] ..... B66F 15/00
(52) U.S. Cl. ..... 254/25; 254/18; 254/21
(58) Field of Search ..... 254/25, 24, 18, 254/131

(56) References Cited

U.S. PATENT DOCUMENTS 2,325,227 A * 7/1943 Chaddock ..... 254/25
6,158,100 A * 12/2000 Peterson et al. ..... 29/267
6,308,934 B1 * 10/2001 Gallo ..... 254/25

* cited by examiner

*Primary Examiner*—Lee D. Wilson

(57) ABSTRACT

A demolition tool for impact hammering, impact pulling and prying is provided which includes an elongate handle defining a passage extending therethrough and first and second rods inserted at respective ends of the handle. The first rod is slidably engaged within the handle and includes a hook at its outer end. The second rod is fixedly secured within the handle and includes a chisel at one end. The chisel can be used for impact chiseling or prying by sliding the first rod to a retracted position, such that its inner end collides with the inner end of the second rod. The hook may used for impact pulling by lifting the handle away from the hook into an expanded position in which the first rod is prevented from leaving the handle by a stopping mechanism. To increase leverage for prying, the tool may be extended to the expanded position. Because the stopping mechanism is within the handle, the risk of injury to the user is reduced. Because the hook and the chisel of the tool are on opposite ends, each implement does not interfere with the utilization of the other.

20 Claims, 8 Drawing Sheets

TELESCOPING DEMOLITION TOOL

This invention relates to a demolition tool which may be utilized for impact pulling, impact hammering and prying.

Multipurpose tools which may be utilized for impact hammering, pulling or prying are known. The impact hammering or pulling is commonly achieved by having a portion of the tool rapidly expandable or contractible upon itself, delivering an impact force for either hammering or pulling or the like. For example, U.S. Pat. No. 776,191 issued Nov. 29, 1904 to Lynch discloses an implement for opening boxes having a blade attached to an end of an elongate rod and a handle which is slidable along the rod at its opposite end. The handle may be slid in the is direction of the blade and stopped against a stopper on the rod to deliver force in the direction of the blade.

U.S. Pat. No. 3,219,316 issued Nov. 23, 1965 to Fried teaches a multi-functional forcible entry tool which includes a handle, driveable along a rod for exerting a hammering force along the length of tool toward a wedge at the end of the tool. Repeated ramming of the handle against a collar piece on the rod, causes the collar piece to strike the wedge, to deliver the hammer force.

Alternately, the hammering or pulling force may be achieved by having a slidable weight piece, movable along a portion of the length of a tool which may be driven against a stopper on the tool, causing an impact force, allowing a pulling or hammering force to be delivered. For example, U.S. Pat. No. 3,568,657 issued Mar. 9, 1971 to Gue, U.S. Pat. No. 5,109,739 to Hull et al., and U.S. Pat. No. 1,873,294 issued Aug. 23, 1932 to Cosgrove each teach a tool which uses a weighted piece which slides along an elongate portion of each tool and which is stopped by a stopper to cause an impact force in the direction of an end of the tool.

Each of the patents discussed above utilizes a sliding hammer or pulling mechanism on the tool, where the contact area to transfer force is on an external portion of the tool. As such, there is the danger and nuisance of the user of the tool being injured as a result of his/her hand being wedged between the moving piece and the stopping piece when using the tool to ram, hammer or pull.

Tools are disclosed which do include internal contact points. For example, early U.S. Pat. No. 840,580 issued Jan. 8, 1907 to McMillan discloses an elongate tool having a nail puller and an inner claw or band cutter on one end and a handle having a recess which is slidable over a length of a shank portion of the tool. The handle may be rapidly slid along the shank and stopped by a lug (or an abutment adjacent to the lug if the shank is rotated during the sliding movement) to deliver a hammer force to the nail puller/band cutter end of the tool. To reverse the direction of the force, the handle is rapidly moved in the direction opposite to the nail puller/band cutter end and is stopped by a pin on the top of the shank portion which engages an abutment within the recess in the tool. Because the nail puller and inner claw are on the same end of the tool, each tends to impede the range of motion and utility of the other.

U.S. Pat. No. 2,582,390 issued Jan. 15, 1952 to E. W. Moore discloses an apparatus for removing a tire from a wheel which includes an elongate rod having an angled pedestal at its bottom end. A slidable handle is fitted over the top end of the rod. The handle portion includes a plug at its top end which blocks the rod from passing through the top of the handle. The top end of the rod includes an enlarged cap which coacts with a cap positioned on the bottom end of the handle to prevent the rod from being removed from the opening. The handle may be raised and rapidly brought down upon the rod to deliver a ramming force to the pedestal to aid in removal of the tire. The rod is stopped against the plug at the top of the opening inside the handle, delivering the hammer force to the pedestal.

The teachings described above are not optimally utilizable for bidirectional application of force along the length of the tool to allow for both impact hammering and pulling in a manner which reduces the risk of injury and which allows for tool implements to be utilized without implements interfering with each other. As such, there is a need for an improved demolition tool.

It is an object of the invention to provide an improved tool which may be used for impact pulling, hammering and prying.

In accordance with an aspect of the invention there is provided a demolition tool comprising an elongate handle portion defining an elongate passage therethrough, a first elongate rod including a hook implement suitable for prying at one end and an opposite end, and a second elongate rod including a demolition type implement at one end and having a second opposite end. A portion of the first rod including its opposite end is slidably secured within the passage from an expanded position to a retracted position. The second rod, including its second end, is fixedly secured to a lower end section of the handle portion. A stopping mechanism prevents the opposite end of the first rod from being pulled from the passage when the first rod is in the expanded position. The first rod can be driven from the expanded position to the retracted position to deliver a hammer blow to the second elongate rod and its demolition type implement.

In a preferred embodiment, the stopping means comprises a stop member rigidly secured to an upper end of the handle portion and a stopper, preferably a ring, secured adjacent to the opposite end of the first rod, the stop member abuts the stopper within said passage in the expanded position.

According to another aspect of the invention, a hand tool useful for prying and demolition comprises an elongate tubular portion having an elongate axial passage therein and having first and second ends; a hook member having a straight, elongate shaft and a hook-forming end section rigidly connected thereto, said elongate shaft being slidable in said passage within said tubular portion from an extended position to a retracted position, said hook member extending into said first end of the tubular portion; stopping means for preventing said hook member from being pulled completely from said passage when the hook member is in said extended position; and an elongate chisel-like member rigidly connected to said second end of said tubular portion and extending therefrom substantially in the axial direction in relation to the tubular portion, wherein said hook member can be driven from said extended position to said retracted position to deliver a hammering blow to said diesel-like member.

According to still another aspect of the invention, a hand tool useful for prying and demolition comprises: an elongate tubular portion having an elongate axial passage therein and having first and second ends; a prying hook member having a straight elongate shaft with an inner end located in said passage and a hook-forming end section rigidly connected to said shaft, said shaft being slidable within said passage from an extended position to a retracted position, said hook member extending into said first end of the tubular portion; and an elongate prying tool member rigidly connected to said tubular portion and extending from said second end in the axial direction relative to the tubular portion, said prying tool member having an outer end and an opposite end located within said tubular portion, wherein said hook member can be driven from said extended position to said retracted position so to hammer said inner end of the shaft against said opposite end of the prying tool member and thereby deliver a hammering blow to said prying tool member.

An advantage provided by the invention is that the hammer force is delivered directly to the demolition type implement, such as a chisel or wedge. A further advantage is that the hammering and pulling contact points are located within the handle thus preventing the risk of injury to the user. Further advantage is that the implements are situated apart from each other such that they do not impede each other's ability to act.

Preferred embodiments of the invention will now be described in conjunction with the accompanying drawings.

In the drawings.

In the drawings like characters of reference indicate corresponding parts in the different figures.

Figure 1:
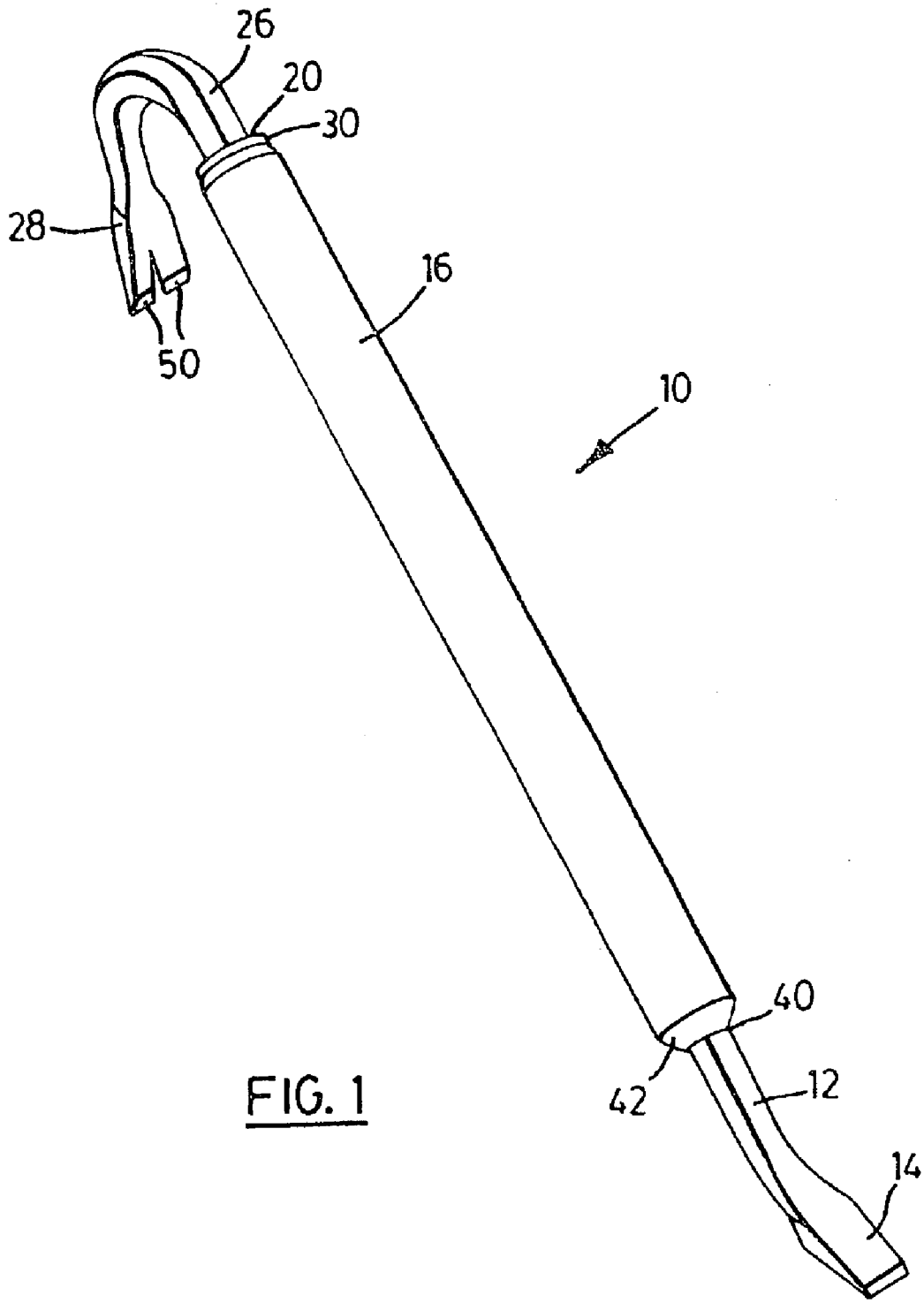
FIG. 1 is perspective view of the preferred embodiment in the retracted position.

As shown in FIGS. 1 to 5, a preferred embodiment of a demolition tool or hand tool 10 includes an elongate tubular handle portion 16 defining a straight passageway 18 therethrough. At the upper end 20 of the elongate axial passage, a metal ring 30 is welded to the handle portion 16. A first elongate rod 26 has a hook implement, preferably a hook 28 at one end and a stop piece (also referred to as a stop member), preferably a ring 32 secured, preferably by welding, adjacent to its inner end 34. A portion of the first rod is slidably secured within the upper end of the passageway 18 and is slidable from an expanded position to a retracted position.

The rod 26 with its hook implement can also be described as a hook member 26 having a straight elongate shaft and a hook-forming end section connected integrally to the shaft.

Figure 3:
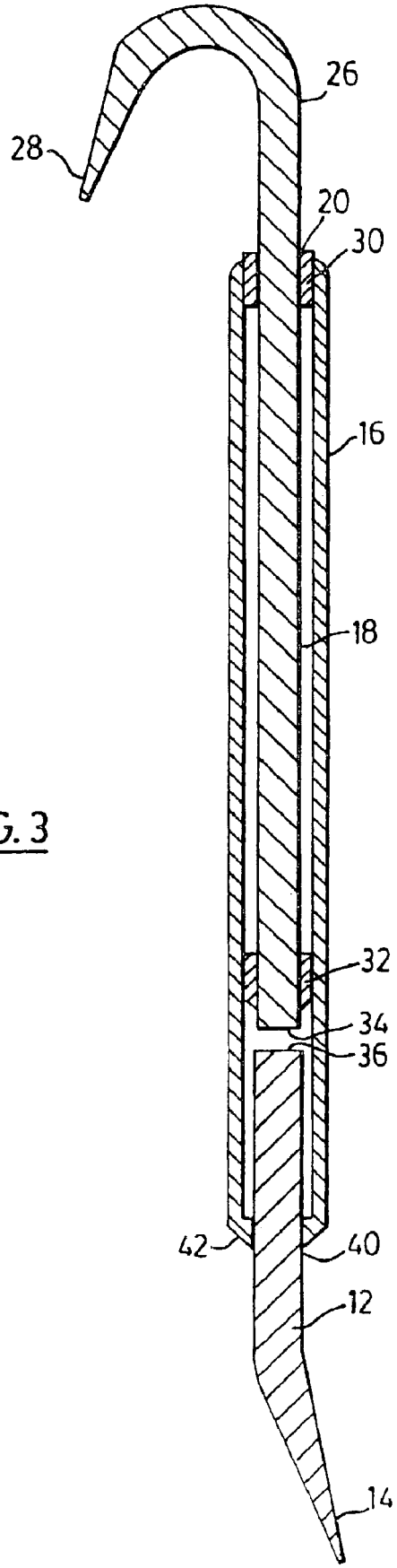
FIG. 3 is a sectional view taken along the length of the preferred embodiment.

A second elongate rod 12 has a demolition-type tool or implement, preferably a chisel 14, at one end and an opposite or inner end 36. As shown in FIG. 3, a portion of the second rod 12 is fixedly attached to one end of the handle portion 16 at the bottom end 40 of the passage 18. This is preferably achieved by welding the rod 12 to the bottom of the handle portion 16. The bottom end of the handle portion preferably includes a tapered end section 42 to which the rod 12 is welded. Alternately, attachment may be achieved by utilizing a ring which is simultaneously welded to the rod 12 and the bottom end of the handle portion. The chisel 14 is one form of an elongate prying tool member which can be rigidly connected to the tubular handle portion 16.

When in the retracted position, as shown in FIG. 1, the inner ends 34, 36 of the first rod and second rod abut each other. This is important because it means that a hammering force can be delivered directly to the chisel 14 as explained further hereinafter.

Figure 2:
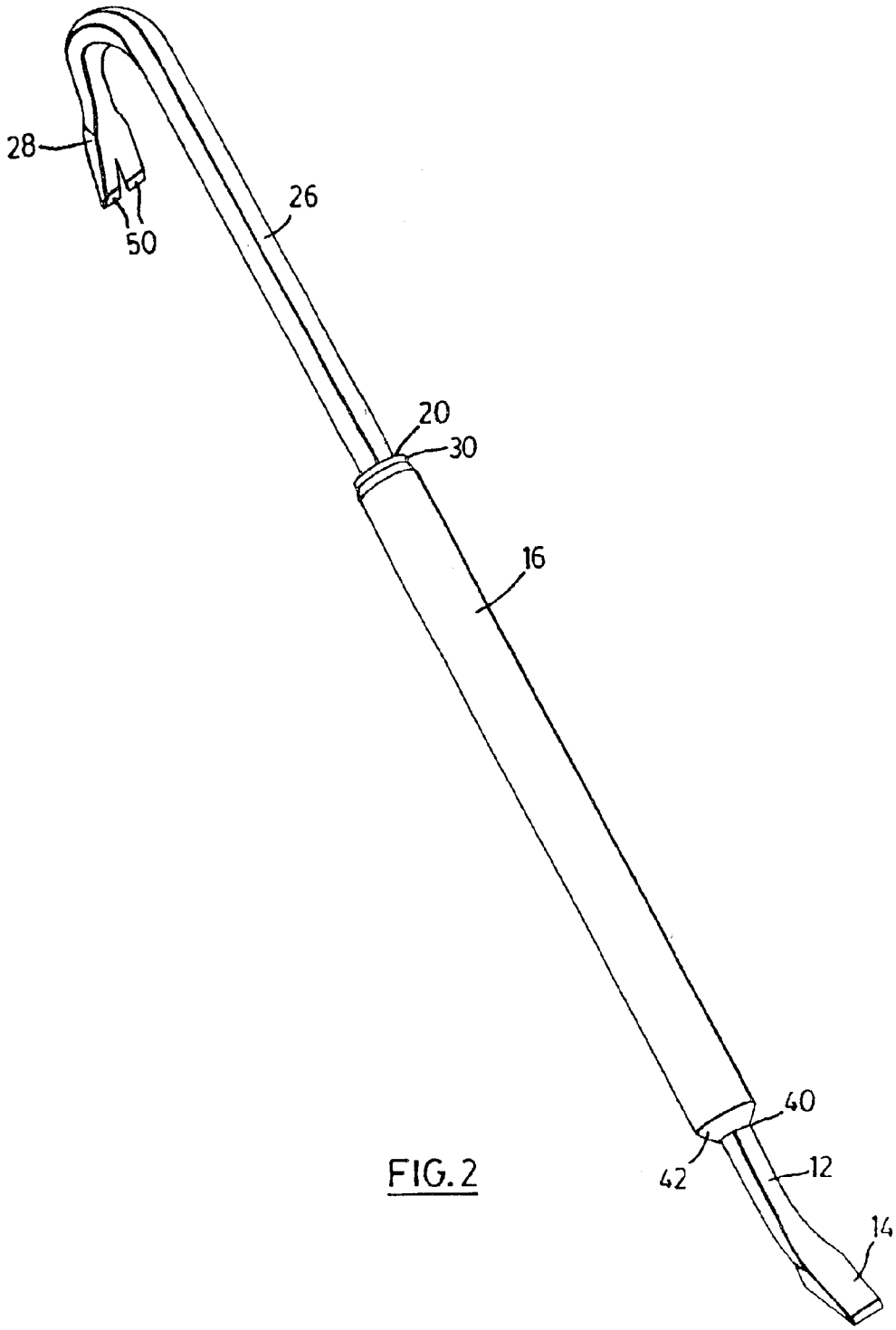
FIG. 2 is a perspective view of the preferred embodiment in the expanded position.
Figure 9:
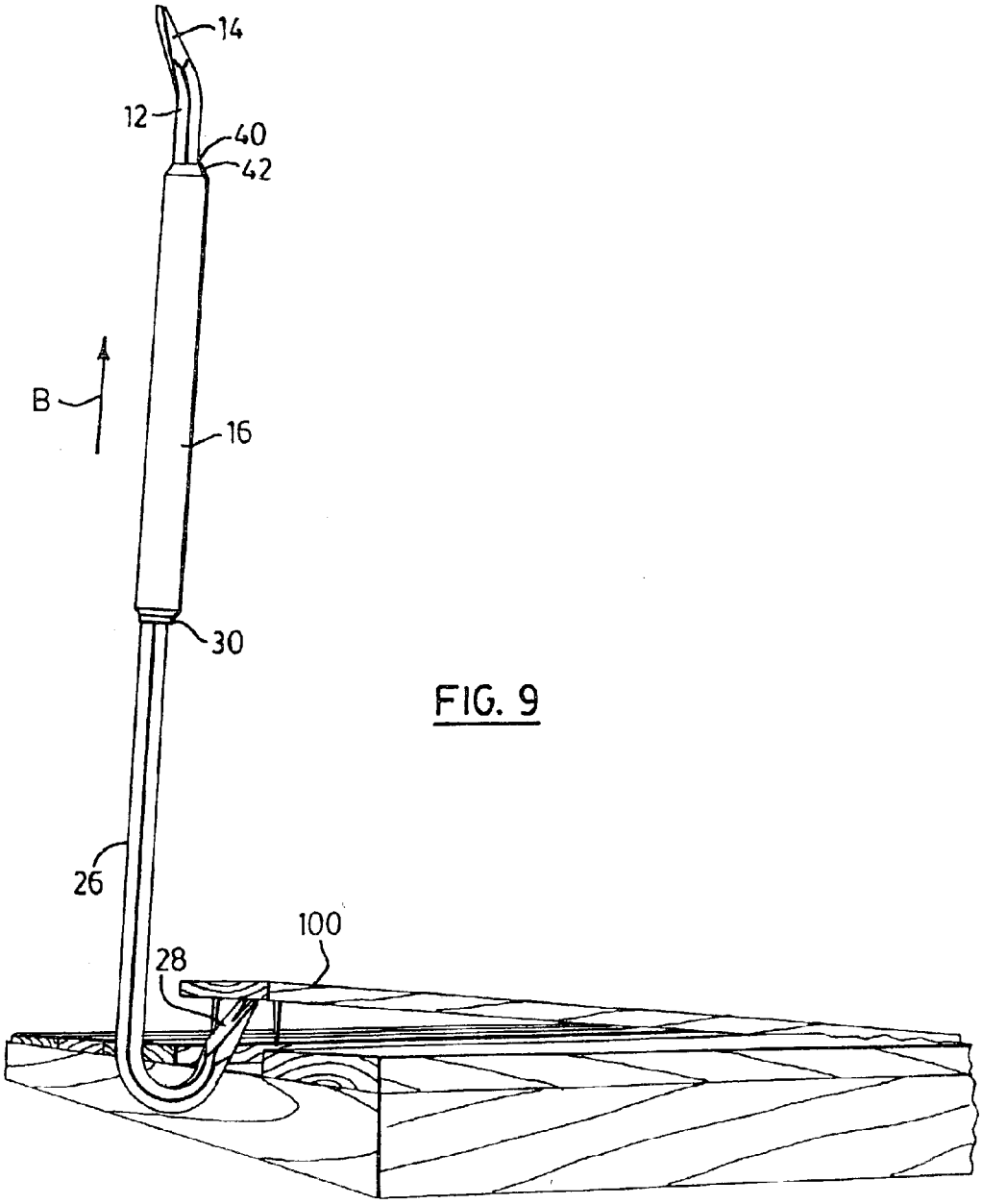
FIGS. 9 and 9*a* are views of the preferred tool being used for pulling.
Figure 9A:
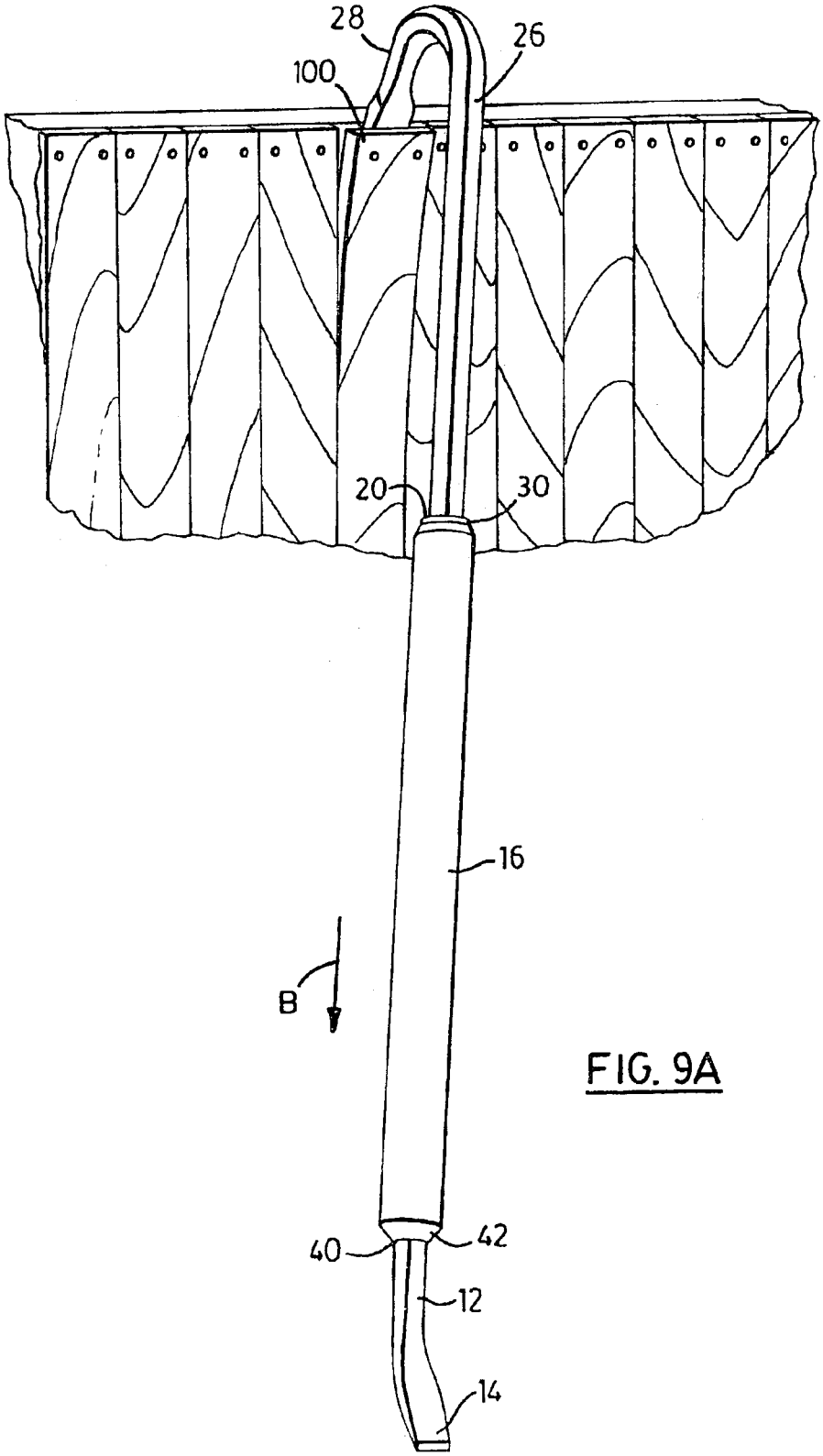

When in the expanded position, shown in FIGS. 2, 9 and 9*a*, a stop member, preferably a ring 32 welded to the first rod 26, abuts a ring 30 at the upper end of the passage, preventing the first rod from being moved beyond this point and thus being removed completely from the passage. The ring 30 can be welded to the handle portion 16 at its upper end. The two rings 30 and 32 together form stopping means for preventing the first rod or hook member 26 from being pulled completely from the passage 18 when the hook member is in the expanded position. The ring 30 can be welded to the handle portion 16 at its upper end. The two rings 30 and 32 together form the stopping means for preventing the first rod from being pulled completely from the passage 18 when the hook member is in the expanded position.

Thus the tools, preferably the chisel 14 and the hook implement 28 are positioned on opposite ends of the tool, and thus neither will interfere with the action of the other, as could occur if they were both situated on the same side of the tool.

Figures 4, 5:
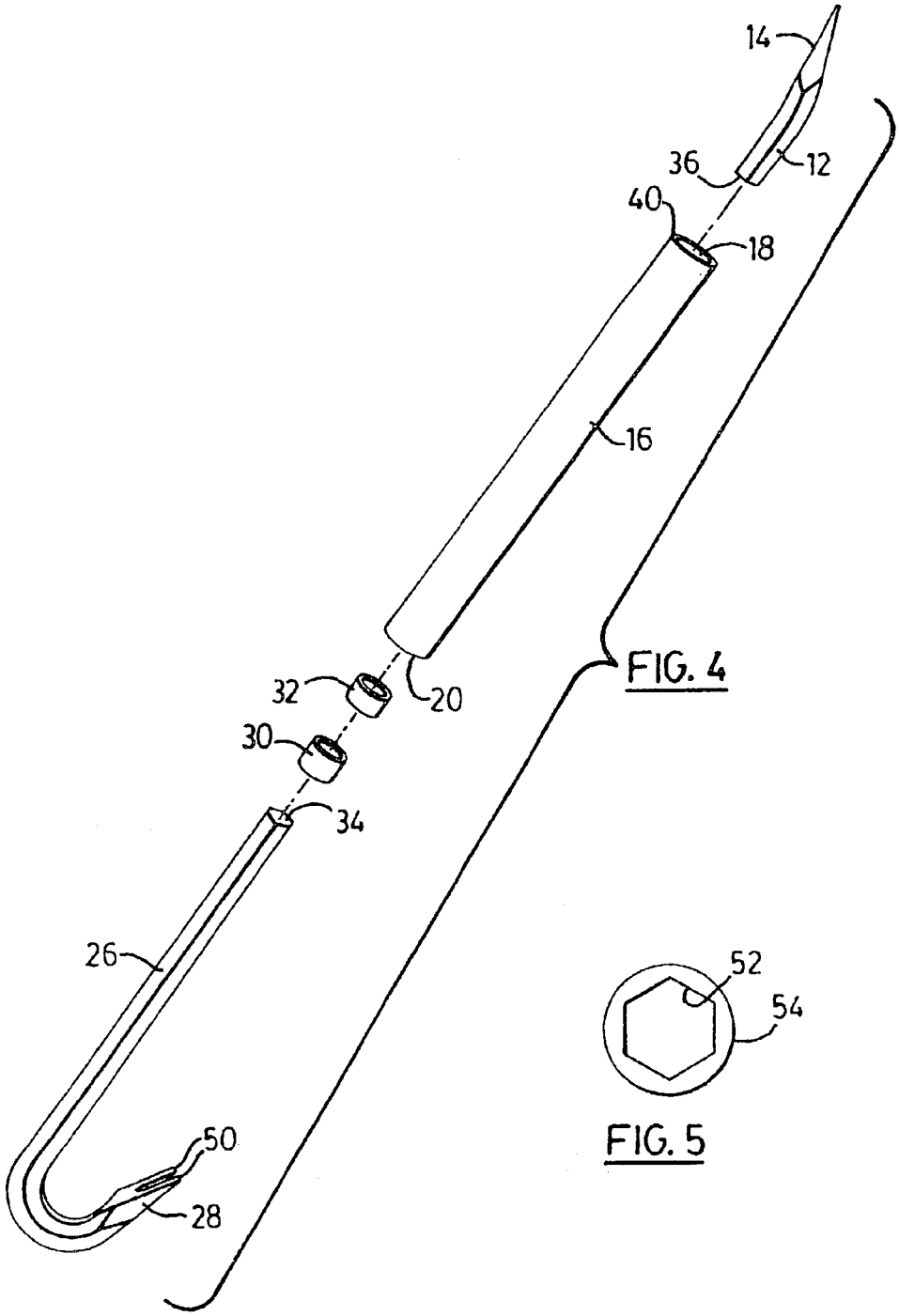
FIG. 4 is an exploded view of the preferred embodiment and showing the separate components thereof.
FIG. 5 is a cross sectional view of a metal ring used in the preferred embodiment.
Figure 6:
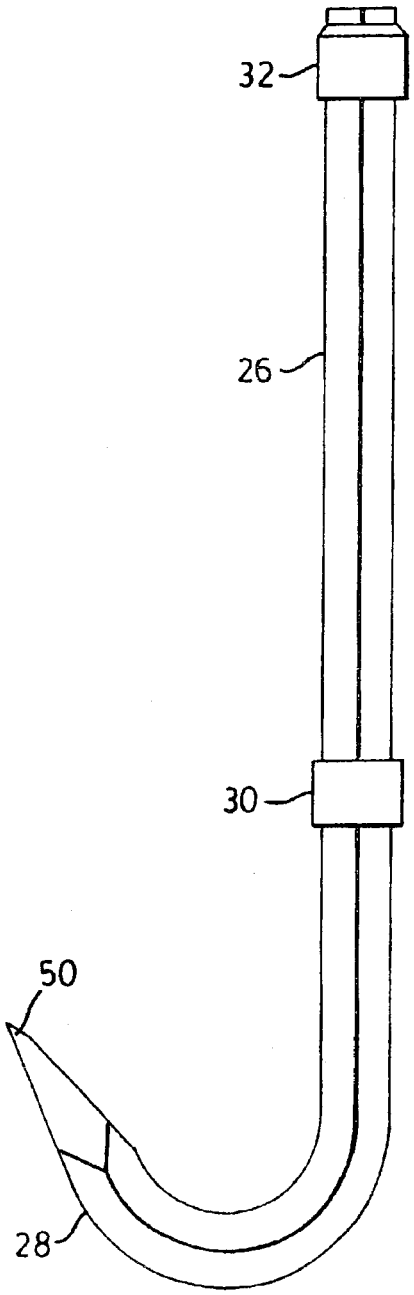
FIG. 6 is a side elevation view of a hook member with rings attached thereto, this hook member being part of the tool.
Figure 7:
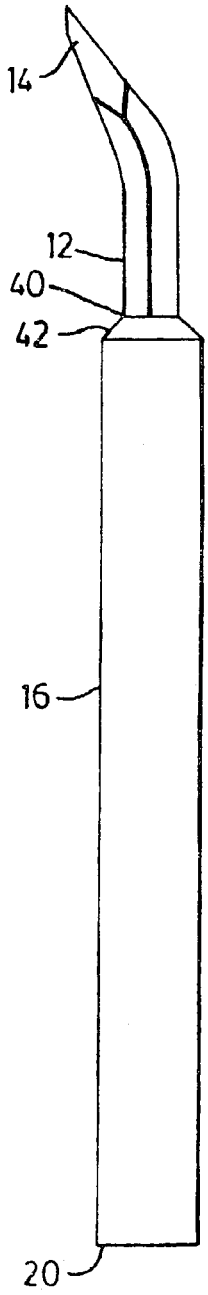
FIG. 7 is a side view of a chisel section which is welded to the handle portion of the preferred embodiment.

As may be best seen in FIGS. 5, 6, 7, the tool is preferably assembled as follows: The second bar or rod 12 is cut to preferred size and its inner end is inserted into the bottom end of the passage, where the rod 12 is welded to the handle portion 16. Rings 30 and 32 are then slid onto the first bar over its inner end 34. Ring 32 is welded to the first rod 26, adjacent to its inner end 34, leaving ring 30 in sliding engagement with the rod. A portion of the first rod is inserted by its inner end into the upper end 20 of the passage of the handle portion. Ring 30 is then welded to the inner circumference of the handle portion at the upper end of the passageway 18.

Figure 8:
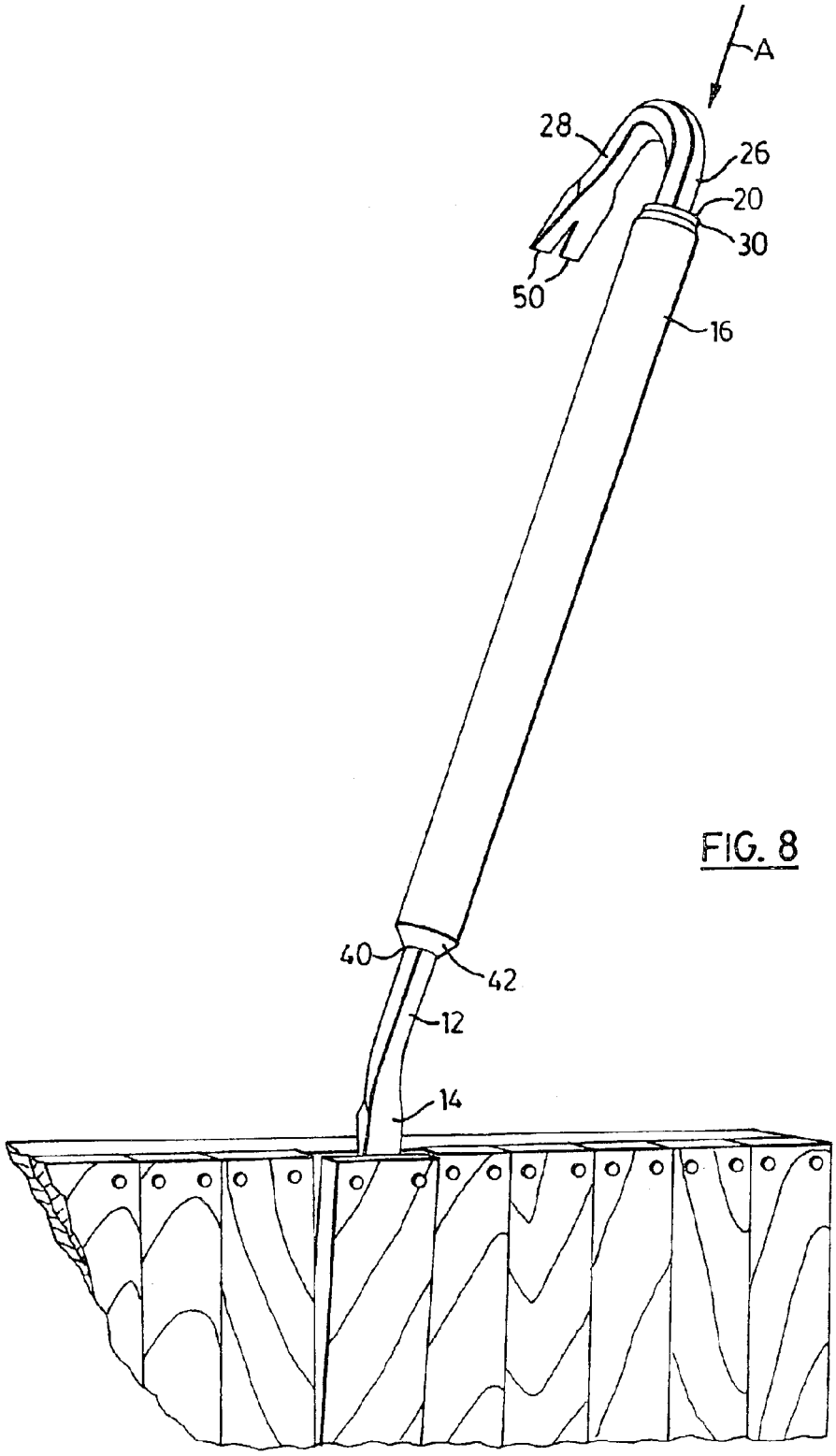
FIG. 8 is a perspective view of the preferred embodiment being utilized for hammering.

As illustrated by FIGS. 3 and 8, to affect a hammering force on the chisel 14 in the direction shown by the arrow A, the user can grasp the first rod or hook member 26, and rapidly and continuously slide it to the retracted position, causing the inner ends 34, 36 of the first and second rods to collide, thus transmitting the force directly to the chisel 14 or other demolition-type tool. Other tool members that can be used in place of the chisel 14 include a pointed member or pike or a hammer head.

As illustrated in FIGS. 9 and 9*a*, the tool may be utilized for impact pulling. To use the tool to pull an item in the direction shown by arrow B, the hook 28 is inserted under the item, for example a board with nails 100. Preferably the hook implement is of sufficient size to pull up a nailed down standard two inch by four inch plank. The user can grasp the handle portion 16 and rapidly and repeatedly lift the handle into the expanded position, causing the ring 30 welded to the upper end of the passageway and the stopper piece, preferably the ring 32, secured to the rod to collide and stop the movement of the handle. This in turn transfers a pulling force to the hook 28.

In the preferred embodiment, each rod or shaft 12, 26 is hexagonal in cross section. As shown in FIG. 5, the internal circumference 52 of rings 30, 32 (which can be similar in shape and size to each other) match the hexagonal shape of the rod 26. The outer circumference 54 of each ring preferably corresponds closely with the inner circumference of the handle passage, each preferably being circular. However, the rods, rings and passage could be any suitable cross section. The preferred ring 32 is welded to the first rod 26 and its outer circumference is slightly less than the inner circumference of the passage, allowing sliding engagement.

Either the chisel 14 or the hook implement (i.e. hook 28) may be utilized for prying. Leverage may be increased by moving the tool to the expanded position.

In the preferred embodiment of the tool, the hook implement further has two substantially parallel prongs 50 at one end thereof which may be utilized for pulling nails by inserting a nail between the prongs. Both the tool or implement at 14 and the hook implement 28 may be modified and adapted to achieve different functions. For example the chisel like member 14 can be replaced by a flat hammer head. Alternatively the demolition tool at this end may have multidirectional jagged or pointed edges to achieve different means of destruction. Likewise the hook implement may be shaped and configured in any suitable manner to effect pulling on an item. For example, it may include one or more hooks or any arrangement of prongs, claws or catches which may be utilized for pulling.

The tool may further include any suitable means to releasably lock the tool in the expanded and the retracted positions.

Since various modifications can be made in the invention as hereinabove described, and many different embodiments of same made within the spirit and scope of the invention, it is intended that all matter contained in the above specification shall be interpreted as illustrative only and not in a limiting sense. All variations and modifications of this invention as within the scope of the accompanying claims are intended to be part of this inventionl.

What is claimed is:

1. A demolition tool comprising:

an elongate handle portion defining an elongate passage there through;

a first elongate rod including a hook implement suitable for prying at one end and an opposite end;

a second elongate rod including a demolition type implement at one end and having an opposite second end;

a portion of said first rod, including said opposite end, being slidably secured within said passage from an expanded position to a retracted position; said second rod, including its second end, being fixedly secured to a lower end section of said handle portion;

stopping means for preventing the opposite end of said first rod from being pulled from said passage when the first rod is in said expanded position, wherein said first rod can be driven from said expanded position to said retracted position to deliver a hammer blow to said second elongate rod and a demolition type implement.

2. A demolition tool as recited in claim 1 wherein said stopping means comprises a stop member rigidly secured to said handle portion within an upper end section of said passage and a stopper secured adjacent to the opposite end of said first rod, and wherein said stop member abuts said stopper in said expanded position.

3. A demolition tool as recited in claim 2 wherein said stopper is a ring welded around the circumference of said first rod and said stop member is a ring welded to said handle portion.

4. A demolition tool as recited in claim 1 wherein said second rod is fixedly secured by welding to said handle portion.

5. A demolition tool as recited in claim 1 wherein said second rod is fixedly secured by means of a retaining ring welded to said second rod and to said handle portion at the bottom end of said passage.

6. A demolition tool as recited in claim 3 wherein substantial portions of said first and second rods are hexagonal in cross section, said internal circumference of said rings matching said hexagonal cross section of said first rod, and the outer circumference of said rings is cylindrical and is equal to or slightly less than the circumference of said passage.

7. A demolition tool as recited in any one of claims 1 to 6 wherein said demolition type implement is a chisel.

8. A demolition tool as recited in any one of claims 1 to 7 wherein said hook implement is a hook having two substantially parallel prongs between which nails can be inserted for pulling.

9. A demolition tool as recited in any one of claims 1 to 8 including a locking device releasably locking the demolition tool in said expanded position.

10. A hand tool useful for prying and demolition comprising:

an elongate tubular portion having an elongate axial passage therein and having first and second ends;

a hook member having a straight, elongate shaft and a hook-forming end section rigidly connected thereto, said elongate shaft being slidable in said passage within said tubular portion from an extended position to a retracted position, said hook member extending into said first end of the tubular portion;

stopping means for preventing said hook member from being pulled completely from said passage when the hook member is in said extended position; and an elongate chisel-shape member rigidly connected to said second end of said tubular portion and extending therefrom substantially in the axial direction in relation to the tubular portion, wherein said hook member can be driven from said extended position to said retracted position to deliver a hammering blow to said chisel-shape member.

11. A hand tool according to claim 10 wherein said hook-forming end section is substantially U-shaped and has two substantially parallel prongs formed on one end thereof, said prongs being adapted for pulling a nail inserted between the prongs.

12. A hand tool according to claim 11 wherein said chisel-like member has a straight connecting section extends into said second end of said tubular portion and is welded to said tubular portion.

13. A hand tool according to claim 10 wherein said stopping means includes a first ring rigidly mounted on an inner end of said elongate shaft and a second ring rigidly mounted at said first end of the tubular portion.

14. A hand tool according to claim 10 or 11 wherein said chisel-like member has a straight connecting section which extends into said second end of said tubular portion and both said elongate shaft and said straight connecting section are hexagonal in transverse cross-section.

15. A hand tool according to claim 10 or 11 wherein said elongate shaft is hexagonal in transverse cross-section and said stopping means includes a stopping ring welded to an inner end of said elongate shaft, said stopping ring forming a hexagonal opening sized to snugly receive said inner end of the shaft.

16. A hand tool useful for prying and demolition comprising:

an elongate tubular portion having an elongate axial passage therein and having first and second ends;

a prying hook member having a straight elongate shaft with an inner end located in said passage and a hook-forming end section rigidly connected to said shaft, said shaft being slidable within said passage from an extended position to a retracted position, said hook member extending into said first end of the tubular portion; and an elongate prying tool member rigidly connected to said tubular portion and extending from said second end in the axial direction relative to the tubular portion, said prying tool member having an outer end and an opposite end located within said tubular portion, wherein said hook member can be driven from said extended position to said retracted position so as to hammer said inner end of the shaft against said opposite end of the prying tool member and thereby deliver a hammering blow to said prying tool member.

17. A hand tool according to claim 16 wherein said hook-forming end section is substantially U-shaped and has two substantially parallel prongs formed on one end thereof, said prongs being adapted for pulling a nail inserted between the prongs.

18. A hand tool according to claim 16 wherein the outer end of said prying tool member is chisel-shaped and said prying tool member is welded to said tubular portion.

19. A hand tool according to any one of claims 16 to 18 including stopping means for preventing said prying hook member from being pulled completely from said passage when said prying hook member is in said extended position.

20. A hand tool according to any one of claims 16 to 18 wherein said elongate shaft has a hexagonal transverse cross-section and a stopping ring with a hexagonal opening is welded to said inner end of said shaft, said stopping ring preventing said prying hook member from being pulled completely from said passage.

* * * * *